United States Patent [19]

Vander Voort

[11] 4,171,233

[45] Oct. 16, 1979

[54] LENS QUALITY OF DIE STEEL

[75] Inventor: George F. Vander Voort, Bethlehem, Pa.

[73] Assignee: Bethlehem Steel Corporation, Bethlehem, Pa.

[21] Appl. No.: 908,419

[22] Filed: May 22, 1978

[51] Int. Cl.[2] ..... C04B 35/70

[52] U.S. Cl. ..... 148/36; 75/123 B; 75/123 N; 75/123 J; 75/123 K; 75/124; 75/128 F

[58] Field of Search ..... 75/124, 123 B, 123 R, 75/123 N, 128 F, 128 V, 128 T, 128 W, 128 A, 123 K, 123 J; 148/36

[56] References Cited

U.S. PATENT DOCUMENTS

| | | | |
|---|---|---|---|
| 2,861,908 | 11/1958 | Mickelson et al. | 75/123 B |
| 2,863,763 | 12/1958 | Rosenberg et al. | 75/123 B |
| 2,919,188 | 12/1959 | Furgason | 75/128 N |
| 3,574,602 | 4/1971 | Gondo et al. | 75/128 F |
| 3,689,329 | 9/1972 | Kern | 75/123 B |
| 3,912,553 | 10/1975 | Waid et al. | 75/128 V |
| 3,928,025 | 12/1975 | Okuno et al. | 75/128 B |
| 4,082,577 | 4/1978 | Heller | 148/36 |

FOREIGN PATENT DOCUMENTS

| | | | |
|---|---|---|---|
| 38-11807 | 7/1963 | Japan | 75/123 B |

OTHER PUBLICATIONS

"Constitution of Binary Alloys," Hanson, 1958, pp. 353–365.

"Stahlschlussel" 10th Ed., 1974, p. 182.

*Primary Examiner*—Arthur J. Steiner

*Attorney, Agent, or Firm*—Joseph J. O'Keefe; William B. Noll

[57] ABSTRACT

A die steel having high hardenability, high hardness, good toughness and capable of achieving a high polished surface flatness in the air or oil quenched and tempered condition. Such steel is ideally suited as a die steel for lens quality and photo-etching applications. The unique combination of properties is accomplished through a careful balancing of the chemistry, particularly control of those elemental additions which promote segregation. Within the broad chemistry limits, by weight, of carbon 0.3 to 0.8%, and the maximum quantities of manganese 3.0%, phosphorus 0.025%, sulfur 0.025%, silicon 2.0%, nickel 4.0%, cobalt 4.0%, chromium 3.0%, vanadium 1.0%, molybdenum 1.5%, tungsten 1.5%, niobium 0.1%, titanium 0.5%, aluminum 0.10%, optionally boron between 0.0005 and 0.012%, balance iron, the desired polishability can be achieved through adherence to the equation:

Surface Roughness ($\mu$-inch)=Boron factor [7.07−12.5(% C)+0.72(% Mn)+0.45(% Si)−2.9 (% Ni)+1.13(% Ni)$^2$+0.87(% Cr)+2.1(% V)+1.12 (% Mo)+0.84(% W)+14(% Nb)], where the calculated Surface Roughness is no greater than 2.65 $\mu$-inch. The Boron factor is 1.0 when boron is not present in the above given range, and 1.74 when boron is present.

7 Claims, No Drawings

LENS QUALITY OF DIE STEEL

BACKGROUND OF THE INVENTION

This invention is directed to a heat treatable, high hardenability die steel characterized by the ability to achieve a lustrous polished surface of exceptional flatness and smoothness. Additionally, the steel of this invention exhibits an unusual combination of high hardness and high toughness, properties which are generally not complementary. More particularly, this invention is directed to a mold steel for use in the plastic molding art.

The growth of the plastic industry has brought about a strong demand for new and better mold steels. This demand to develop better mold steels has resulted from higher pressures being used in compression molding, the abrasiveness of thermal setting resins such as the phenolics, and the need for better dimensional stability in conjunction with greater intricacy of mold articles being produced.

The breakthrough of plastics into the field of lenses has added to these demands. For example, plastics are now being used for such critical, but diverse, applications as contact lenses, opthalomological lenses, sunglasses, safety glasses, welders' goggles, camera lenses, rifle scopes, and lenses for industrial optical instruments. Such uses have given rise to a requirement for "lens quality" molds.

In molds for plastic applications there are basically two quality levels: "mold quality" and, the higher or more restrictive level "lens quality". The standard, as used in the art, is one based on the projected capabilities of a given steel. While the test is basically subjective, experience is being gained in part through trial and error. Such experience can now be translated into certain minimum conditions or observations.

Lens quality steel is more restrictive since molds therefrom are prepared to a finer surface finish than mold quality steel. Any imperfection on the polished surface that is visible to the eye will be detrimental. That is, if one can observe pits or marks from holes, inclusions, carbides, etc., the steel is not suitable for lens quality. Likewise, a coarse grain size can produce unevenness. Thus, cleanliness and grain size are just two factors which affect polishability. Others are considered below.

Polishability will improve with increasing hardness. A minimum of $R_c30$ is therefore required for a good mold finish. However, if a high lustre is desired, such as for lens quality applications, a hardness of at least $R_c54$ is necessary. Adequate hardness is also essential to proper wear resistance. To resist abrasive wear from such plastics as the very demanding thermosetting resins, a hardness of at least $R_c54$ is needed.

Finally, there are metallurgical factors which affect polishability. (1) Excessive retained austenite, a relatively soft phase in the harder martensitic matrix, does not take a polish well. That is, polishing of a steel surface containing excessive retained austenite results in a random pattern of hills and valleys, the valleys representing the retained austenite which is softer and is abraded more readily during polishing. (2) Carbides, whether large globular carbides or carbide networks, tend to stand in relief after polishing. As a consequence, the carbides should be fine and uniformly dispersed. (3) Presence of non-martensitic constituents such as bainite, pearlite or ferrite in the microstructure will increase surface roughness since they are softer than martensite.

The die steel of the present invention was developed to meet the above demands. Through research and development, with the above criteria as goals, the present invention resulted in the development of a new die steel having the following properties:

1. High surface hardness, preferably at least 55 HRC, to obtain the desired lustre and high abrasion resistance.
2. Freedom from harmful inclusions and a homogeneous microstructure for optimum polishability and photo etchability.
3. Dimensional stability in heat treatment to minimize clean up.
4. Sufficient toughness at the high hardness level to prevent cracking under the injection pressure load encountered in the plastic molding operations.

This unique combination of properties for steels of the present invention is accomplished through a careful balancing of the chemistry. Specifically, within the broad chemistry limits, by weight, of carbon 0.3 to 0.8%, and the maximum quantities of manganese 3.0%, phosphorous 0.025%, sulfur 0.025%, silicon 2.0%, nickel 4.0%, cobalt 4.0%, chromium 3.0%, vanadium 1.0%, molybdenum 1.5%, tungsten 1.5%, niobium 0.1%, titanium 0.5%, aluminum 0.1%, optionally boron between 0.0005 and 0.012%, balance iron, the desired properties can be achieved through adherence to the following equation:

Surface Roughness ($\mu$-inch) = Boron factor [7.07–12.5 (% C) + 0.72 (% Mn) + 0.45 (% Si) − 2.9 (% Ni) + 1.13 (% Ni)$^2$ + 0.87 (% Cr) + 2.1 (% V) + 1.12 (% Mo) + 0.84 (% W) + 14 (% Nb)], where the calculated Surface Roughness is no greater than 2.65 $\mu$-inch. The Boron factor is 1.0 when boron is not present in the above given range, and 1.74 when boron is present.

Most of the steels used in the plastic industry as molds were developed prior to the recent expansion of such industry. Few, if any of the steels, were developed specifically as mold steels. As a consequence, such presently used steels often exhibit certain features which minimize their usefulness as plastic mold steels. Such features became more obvious as the demands of the plastic industry increased, particularly in the molding of lenses. Four different steels, whose nominal chemistry is listed in Table I, represent typical steel presently used and/or promoted for plastic mold applications.

TABLE I

| Prior Art Mold Steels | C | Mn | Si | Cr | Mo | Fe |
|---|---|---|---|---|---|---|
| A | .50 | .70 | .25 | 3.25 | 1.40 | bal. |
| B | .50 | 1.00 | .30 | 1.10 | .25 | bal. |
| C | .30 | .80 | .50 | 1.70 | .40 | bal. |
| D | .35 | .25 | .50 | 13.00 | | bal. |

The first of such prior art mold steels, steel A, though possessing a combination of good toughness and wear resistance, suffers the problem known as chemical banding. Many carbon and low alloy steels in the hot-worked condition exhibit banding, defined as a fibrous microstructure of layered pearlite and ferrite. The term banding has also been used to describe other phenomenon where the microstructure had a periodic or intermittent variation of alloy content in a laminated form.

The inhomogeneity in alloy steels does not necessarily lead to the production of two separate phases as in carbon steels. Steel A, when treated in the conventional manner reveals bands which are tempered martensite but nevertheless have different chemical composition and micro-hardnesses. Such differences present problems in achieving a highly polished surface.

Another drawback of alloy steels is the presence of complex alloy carbides. Such carbides can appear with large amounts of chromium, vanadium, molybdenum and tungsten. Such carbides may be eliminated through the use of high austenizing temperatures to insure that the carbon is brought into solution. However, with high austenizing temperatures difficulty in controlling dimensions may arise. On the other hand, should the carbides not be put into solution, they will tend to segregate into bands. On the polished surface such segregated bands will appear as carbide streaks. Generally, these carbides are harder than the matrix and will stand out in relief above the matrix. Such a feature presents an obvious problem in attempting to polish a surface containing the carbides to a high lustre.

Alloys B and C are two further alloy steels used for mold applications, but whose chemistries are leaner than the chemistry of Alloy A. An undesirable feature of Alloy B is that it is a low hardenability steel with limited oil hardenability. Also, like its companion Alloy C, the significant amount of Cr and Mo present in the alloy makes it susceptible to segregation. Similarly, Alloy C has its drawbacks which limit its effectiveness as a lens quality mold steel. For instance, Alloy C is a prehardened mold steel characterized by low hardness, i.e. 285/321 HB. This results in a mold surface having insufficient lustre, the liklihood of smeared surface metal, and low wear resistance.

As noted above high hardness is a necessary property of mold steels to achieve a highly polished surface. One of the most serious drawbacks to Alloy D (Type 420 stainless steel) is that it can be hardened to only about $50/52R_c$.

The present invention avoids the shortcomings of the prior art steels through the economical use of such alloying agents as tungsten, vanadium, molybdenum, chromium and nickel. However, since a high level of hardenability was required, a certain amount of such alloy additions was required. The present invention recognized the way of achieving the high hardenability while minimizing surface roughness.

SUMMARY OF THE INVENTION

A hardenable, lens quality grade steel suitable as a die steel for plastic mold applications. Though properties can be varied, in the preferred air or oil quenched and tempered condition such steel is characterized by a minimum hardness of at least 55 HRC and a Charpy V-notch toughness of at least 6ft-lbs. By weight percent, the steel of this invention in its broadest and most preferred limits comprises:

| Alloying Additions | Broad Range | Preferred(1) | Preferred(2) |
|---|---|---|---|
| C | .3–.8 | .47–.56 | .47–.57 |
| Mn | up to 3.0 | 1.3–1.6 | 1.8–2.1 |
| Si | up to 2.0 | .15–.30 | .15–.30 |
| Ni | up to 4.0 | 1.1–1.5 | 1.1–1.5 |
| Co | up to 4.0 | up to .01 | up to .01 |
| Cr | up to 3.0 | .15–.25 | .30–.50 |
| V | up to 1.0 | .08–.20 | .08–.20 |

-continued

| Alloying Additions | Broad Range | Preferred(1) | Preferred(2) |
|---|---|---|---|
| Mo | up to 1.5 | .20–.30 | .65–.80 |
| W | up to 1.5 | .15–.30 | .35–.45 |
| Nb | up to .1 | up to .005 | up to .005 |
| Ti | up to .5 | .02–.04(4) | .02–.04 |
| Al | up to .10 | .02–.06 | .02–.06 |
| P | up to .025 | up to .025 | up to .025 |
| S | up to .025 | up to .025 | up to .025 |
| B | .0005 to .012 | .001–.003(3) | .001–.003 |
| Fe | balance | balance | balance |

(1)Preferred range - oil hardenable grade
(2)Preferred range - air hardenable grade
(3)Optional
(4)Titanium added if boron present To achieve the optimum properties, particularly an ability of the steel to be polished to a high lustre, the chemistry of the steel according to this invention must be balanced within the above recited ranges according to the equation:

Surface Roughness ($\mu$-inch)=Boron factor [7.07–12.5 (% C)+0.72 (% Mn)+0.45 (% Si)−2.9 (% Ni)+1.13 (% Ni)$^2$+0.87 (% Cr)+2.1 (% V)+1.12 (% Mo)+0.84 (% W)+14 (% Nb)], where the calculated Surface Roughness is no greater than 2.65 $\mu$-inch. The Boron factor is 1.0 when boron is not present in the above given range, and 1.74 when boron is present.

DETAILED DESCRIPTION OF PREFERRED EMBODIMENTS

This invention is directed to a chemically balanced, ferrous alloy suitable as a die steel for plastic mold applications. A critical feature of the die steel according to this invention is the recognition of the important influence of such steel's chemistry on surface roughness. The achievement of a projected surface roughness no greater than about 2.65 $\mu$-inch in the heat treated condition was gained without significantly sacrificing hardness, hardenability and toughness. It was discovered that a relationship existed among the alloying additions to such steel, and that there was an order of significance in achieving the desired result. These recognitions led to the establishment of the following limits and relationship.

The steel of this invention, by weight, may be characterized by these limits: carbon 0.3 to 0.8%, and the maximum quantities of manganese 3.0%, phosphorus 0.025%, sulfur 0.025%, silicon 2.0%, nickel 4.0%, cobalt 4.0%, chromium 3.0%, vanadium 1.0%, molybdenum 1.5%, tungsten 1.5%, niobium 0.1%, titanium 0.5%, aluminum 0.1%, optionally boron between 0.0005 and 0.012%, balance iron. Through adherence to the relationship established by the equation to follow, the desired properties of this invention may be realized.

Surface Roughness ($\mu$-inch)=Boron factor [7.07–12.5 (% C)+0.72 (% Mn)+0.45 (% Si)−2.9 (% Ni)+1.13 (% Ni)$^2$+0.87 (% Cr)+2.1 (% V)+1.12 (% Mo)+0.84 (% W)+14 (% Nb)], where the calculated Surface Roughness is no greater than 2.65 $\mu$-inch. The Boron factor is 1.0 when boron is not present in the above given range, and 1.74 when boron is present.

It should be understood that while the surface roughness level of "no greater than 2.65 $\mu$-inch" is a quantitative measure, it is in actuality a relative measure of the capabilities of a given mold steel as influenced by certain factors. Such factors include the polishing equipment, material and operator; the sophistication of the surface measuring equipment; and the steel making practice in preparing the mold steel. Paramount among the factors of the steel making practice are the specific deoxidation practice and the ingot size. For instance, the ingot solidification rate decreases with increasing ingot size. Thus, in the slower cooling large ingots alloy segregation will differ from that of an identical steel ingot cast in a relatively rapidly cooled small ingot mold.

With all of the above factors equal, except for variation in ingot sizes, one will observe that there is a linear relationship between surface roughness and ingot size. That is, increasing ingot size means greater surface roughness. Nevertheless, the above Surface Roughness equation represents an effective tool in determining the polishability of a given mold steel, even though the actual attainable surface roughness thereof may vary in practice.

The final or desired properties of the steels of this invention are found in the heat treated product. There are, however, preferred ranges within the broad range outlined above, where the precise range selected depends on the heat treating cycle. Thus, there is a preferred range for an air hardenable grade, and one for an oil hardenable grade.

For each grade, the heat treating cycle includes austenitizing the steel at a temperature of about 1650° F., preferably in the range of 1600° to 1700° F., followed by cooling. Such cooling may be either in air or quenching in oil. Following this hardening treatment, which produces an essentially martensitic microstructure, the steel is subjected to a single or double temper at about 300° to 400° F. The preferred ranges for the respective grades are as follows:

| Alloying Additions | Oil Hardenable Grade | Air Hardenable Grade |
|---|---|---|
| C | .47-.56 | .47-.57 |
| Mn | 1.3-1.6 | 1.8-2.1 |
| Si | .15-.30 | .15-.30 |
| Ni | 1.1-1.5 | 1.1-1.5 |
| Co | up to 4.0 | up to .01 |
| Cr | .15-.25 | .30-.50 |
| V | .08-.20 | .08-.20 |
| Mo | .20-.30 | .65-.80 |
| W | .15-.30 | .35-.45 |
| Nb | up to .005 | up to .005 |
| Ti | .02-.04* | .02-.04 |
| Al | .02-.06 | .02-.06 |
| P | up to .025 | up to .025 |
| S | up to 0.25 | up to 0.25 |
| B | .001-.003* | .001-.003 |
| Fe | balance | balance |

*Boron optional, Titanium presesnt when Boron added

The present invention is based on the premise of utilizing relatively small amounts of tungsten, vanadium, molybdenum, chromium, nickel, and boron, to obtain a high level of hardenability while minimizing surface roughness. This result was achieved through an intensive investigation and correlation of the alloying additions to the steels of this invention. The selection parameters and/or influence on the development of desired properties for each alloying addition follows below.

A—ALLOYING ADDITIONS

CARBON

The difficulties in attempting to optimize the particular amount of alloying addition to be made to the steel of this invention is clearly reflected in the considerations of the carbon content. The influence of carbon on as-quenched martensitic hardness is well known. To achieve a high-tempered hardness requires at least 0.40% carbon. However, for a prehardened die steel, a lower limit of 0.30% is acceptable. Above about 0.60% there is no further increase in as-quenched hardness. The upper limit of 0.8% is based on the fact that the steels of this invention can only tolerate a small amount of very fine carbides. While the above established a broad limit based upon hardnesses, there were other considerations which needed to be considered. For example, toughness decreases as the carbon content increases. As a consequence, low carbon is preferred. In addition, with the higher amounts of carbon there will result an excessive amount of retained austenite. However, with the higher carbon contents there appears an improvement in surface roughness. This effect is explained on the basis of the hardness difference between the dendritic and interdendritic areas.

Alloy segregation causes the carbon to segregate with the result that there is a carbon enriched area and a carbon depleted area; hence, a hardness difference between such areas. With changes in total carbon, the differences in hardness may or may not be a constant difference. For example, from 0.1 to 0.52%, by weight carbon, the hardness increases linearly at a rate of about 6.8 HRC units for every 0.08% increase in carbon. However, from 0.53 to 0.60% carbon, the as-quenched hardness rises only 2 HRC units. With further increases of carbon, above about 0.60%, the hardness remains constant. There is one note of caution, in the high carbon range one may experience a drop in hardness due to the presence of an excessive amount of retained austenite. In summary then, lower amounts of carbon will result in insufficient hardness while higher amounts will result in an excessive amount of retained austenite and loss in toughness. Accordingly, a preferred carbon range is between 0.4 and 0.7%, with the most preferred ranges as given above.

MANGANESE

Manganese is an important addition to the steels of this invention since manganese lowers the eutectoid temperature, is a highly effective hardenability agent, and has a minor influence on surface roughness. Accordingly, the broad range of manganese is up to a maximum of 3%. A preferred range of manganese is one established by the limits of 1.2 to 2.2%. This preferred range is based on the fact that as manganese moves into the higher portion of the broad range there is a tendency to form excessive retained austenite. Within such preferred range there are the more preferred ranges for the oil-hardenable and air-hardenable versions as set forth above.

SULPHUR

Sulphur is considered next due to its close association with manganese. Virtually all of the sulphur in steel is segregated into the interdendritic region where it forms manganese sulfides. The greater the sulphur content, the more manganese tied up in this manner and the lower the hardenability. As the sulfur level increases the sulfides get larger. Sulfides are quite soft, especially compared to a hardened die steel. Upon polishing, the sulfides may or may not be "pulled" out. Sulfides abrade more readily on polishing—get a "dished" appearance. Further, sulphur is generally undesirable since it reduces toughness. As a consequence, the preferred maximum content of sulphur is 0.025%. While the most preferred maximum would be one established at 0.01%, an acceptable preferred maximum of 0.015 is preferred in practice.

NICKEL

Nickel has a complex influence on surface roughness. The investigation resulting in the invention herein revealed a significant improvement in surface roughness as the nickel increases up to about 1.5%. Thereafter surface roughness deteriorates slightly up to about 2.5%. However, as the nickel content increases the amount of preferred orientation of retained austenite increases markedly detracting from the transverse impact toughness. Further, since nickel has only a minor influence on hardenability, its presence in the steels of this invention is primarily for its influence on surface roughness. As a consequence, while a broad range of up to 4% is contemplated, a preferred range of nickel is from about 1 to 1.7%, with a more preferred range of 1.1 to 1.5%.

CHROMIUM

While chromium is an important element for improving hardenability it has been found to be detrimental to texturing when present in amounts between about 2 and 4%. Further, chromium is a significant factor in increasing surface roughness. Finally, as explained earlier, chromium has also been shown to be primarily responsible for the visual appearance of banding in the class of steels to which the present invention relates. Thus, while chromium must be used for hardenability, it is preferred to maintain the chromium content below the maximum limit of about 3%. Preferably, the chromium should not exceed about 0.75%, and more preferably maintained within the limits set forth in the tabulation above.

VANADIUM

While vanadium may be present in amount up to 1%, it is preferred to maintain the vanadium at a rather low level such as between about 0.08 to about 0.2%. It was discovered that with vanadium contents in excess of 0.35%, high austenitization temperatures were required in order to bring the carbides into solution. Such temperature, on the order of 1850° F. or higher, are not suitable for lens quality mold steels. In addition, vanadium was found to be detrimental to the transverse impact strength and highly detrimental to polished surface flatness.

MOLYBDENUM

Molybdenum is an expensive alloying agent; however, it is very important from a hardenability standpoint and was shown to improve both transverse and longitudinal impact properties. Its influence on surface roughess is intermediate between the influence of chromium and vanadium, namely, worse than chromium, but not as detrimental as vanadium. In the manner of vanadium, molybdenum in high concentrations will result in higher austenitizing temperatures but, for an equal weight percent, the influence is not as great as for vanadium. Accordingly, for a broad range, an upper limit of 1.5 wt. % molybdenum was selected, with a preferred range up to about 1.0%. The most preferred ranges are 0.20/0.30 and 0.65/0.80 wt. % molybdenum for oil- and air-hardenable grades, respectively.

TUNGSTEN

While little has been published on the ability of tungsten to improve hardenability, a comparison of two air-hardenable steels according to this invention revealed a slight improvement in depth of air hardenability with the addition of 0.34%, by weight. Thus, where some improvement in hardenability may follow with the addition of tungsten, large quantities raise the austenitizing temperature—a feature to be avoided herein. Finally, as to surface roughness, the influence of tungsten was similar to that of chromium. As a consequence, 1.5% represents a maximum limit with 0.75% a preferred maximum.

PHOSPHORUS

Phosphorus is normally regarded as an undesirable impurity element in steel. The usual electric furnace restriction of 0.025% is acceptable.

COBALT

While cobalt is quite similar in behavior to nickel, its use in the steels of this invention is not recommended since it has a negative influence on hardenability.

NIOBIUM

Niobium (columbium) forms fine, hard carbides in steel which impart wear resistance to such steel. However, niobium's use herein must be limited due to the great tendency of this element to segregate.

BORON

While boron treated steels do exhibit noticeably higher surface roughness than a steel of the same composition without boron, its use in imperative in producing an air hardenable grade according to this invention. Without the use of boron, considerable chromium, molybdenum or other additions would be required to achieve the same level of hardenability resulting in greater cost and greater surface roughness.

B—SELECTING A BALANCED CHEMISTRY

In designing a lens quality steel according to this invention, initial consideration should be given to the carbon content, specifically the amount of carbon needed to obtain the desired hardness. For instance, if a prehardened type grade, with hardnesses in the range of 302 to 341 HB, is desired, a carbon content of between 0.30 to 0.35%, by weight, is adequate. However, if high tempered hardness above about 56 HRC is desired, a range of 0.47 to 0.55%, by weight, should be selected. Following such carbon selection consideration can then be given to the further alloying additions.

Such selection is based primarily on their influence on hardenability; however, the ultimate selection must also incorporate consideration of the particular addition's influence on surface roughness and the influence of such addition on the tendency to segregate. Extensive studies, resulting in the invention herein, have established a ranking to assist in the selection of alloying additions for the steels of this invention.

TABLE II

| Alloy Addition | Influence on Surface Roughness Very Detrimental → Beneficial | | | | |
|---|---|---|---|---|---|
| S | X | | | | |
| B | X | | | | |
| Nb | X | | | | |
| V | | X | | | |
| Mo | | X | | | |
| W | | | X | | |
| Cr | | | X | | |
| Mn | | | | X | |
| Si | | | | X | |
| Ni | | | | | X |

In establishing the alloy addition's influence on the tendency to segregate, the segregation ratio for each said addition was determined. By definition, "segregation ratio" is defined as the ratio of the concentration of the element in the interdendritic region to the concentration of such element within the dendrite. Thus, the higher the segregation ratio, the stronger the tendency thereof to segregate.

TABLE III

| Alloy Addition | Tendency to Segregate Very Strong → Minor | | | | |
|---|---|---|---|---|---|
| S | X | | | | |
| Nb | X | | | | |
| B | X | | | | |
| P | | X | | | |
| V | | | X | | |
| Mo | | | X | | |
| W | | | X | | |
| Cr | | | X | | |
| Mn | | | X | | |
| Si | | | | X | |
| Ni | | | | X | |

Through the aid of the preceding discussion on the major alloying additions and TABLES II and III, it was possible to correlate the chemistry of the steels of this invention to arrive at a proper balance and achieve the desired properties. Such correlation is defined by the chemistry limits of carbon 0.3 to 0.8%, and the maximum quantities of manganese 3.0%, phosphorus 0.025%, sulfur 0.25%, silicon 2.0%, nickel 4.0%, cobalt 4.0%, chromium 3.0%, vanadium 1.0%, molybdenum 1.5%, tungsten 1.5%, niobium 0.1%, titanium 0.5%, aluminum 0.10%, optionally boron between 0.0005 and 0.012%, with the balance iron, and the equation:

Surface Roughness ($\mu$-inch) = Boron factor [7.07−12.5 (% C)+0.72 (% Mn)+0.45 (% Si)−2.9 (% Ni)+1.13 (% Ni)$^2$+0.87 (% Cr)+2.1 (% V)+1.12 (% Mo)+0.84 (% W)+14 (% Nb)], where the calculated Surface Roughness is no greater than 2.65 $\mu$-inch. The Boron factor is 1.0 when boron is not present in the above given range, and 1.74 when boron is present.

C—SPECIFIC EMBODIMENTS

TABLE IV

| | CHEMISTRY, BORON CONTAINING STEELS | | | | | | | | | | | | | |
|---|---|---|---|---|---|---|---|---|---|---|---|---|---|---|
| Steel* | C | Mn | P | S | Si | Ni | Cr | V | Mo | W | Al | Ti | B | Nb |
| A | .55 | 1.5 | .012 | .007 | .29 | 1.5 | .21 | .19 | .26 | .21 | .045 | .030 | .001 | — |
| B | .55 | 1.55 | .013 | .009 | .25 | 1.5 | .22 | .19 | .24 | .20 | .063 | .035 | .003 | — |
| C | .49 | 1.46 | .010 | .008 | .22 | 1.6 | .16 | .17 | .23 | .20 | .057 | .037 | .002 | — |
| D | .54 | 1.49 | .011 | .007 | .29 | 1.54 | .18 | .17 | .23 | .21 | .073 | .048 | .003 | — |
| E | .59 | 1.96 | .016 | .009 | .24 | 1.31 | .16 | .09 | 1.08 | .37 | .09 | .034 | .002 | — |
| F | .44 | 1.24 | .008 | .009 | .19 | 1.29 | .15 | .14 | .17 | .24 | .039 | .027 | .004 | — |
| G | .55 | 1.90 | .003 | .006 | .19 | 1.24 | .24 | .09 | .70 | .41 | .049 | .030 | .003 | — |
| H | .56 | 1.87 | .011 | .005 | .21 | 1.29 | .55 | .09 | .73 | .36 | .040 | .033 | .003 | — |
| I | .56 | 1.59 | .016 | .009 | .22 | 1.32 | .42 | .10 | .94 | .34 | .034 | .032 | .002 | — |
| J | .50 | 1.48 | .010 | .007 | .19 | 1.31 | .38 | .10 | .94 | — | .039 | .029 | .003 | — |
| K | .54 | 1.44 | .010 | .005 | .17 | 1.33 | .40 | — | .94 | — | .032 | .028 | .003 | — |
| L | .58 | 1.79 | .012 | .005 | .20 | 1.32 | .27 | .08 | .72 | .38 | .047 | .008 | .003 | .025 |
| M | .56 | 1.94 | .012 | .008 | .22 | 1.30 | .32 | .10 | .73 | .37 | .050 | .007 | .002 | .058 |

*500 lb., laboratory ingots

TABLE V

| | CHEMISTRY, BORON FREE STEELS | | | | | | | | | | | |
|---|---|---|---|---|---|---|---|---|---|---|---|---|
| Steel* | C | Mn | P | S | Si | Ni | Cr | V | Mo | W | Al | Ti |
| N | .50 | 1.38 | .017 | .011 | .43 | 1.37 | .22 | .17 | .23 | .19 | .026 | .006 |
| O | .54 | 1.46 | .016 | .009 | 1.07 | 1.36 | .22 | .18 | .23 | .19 | .014 | .006 |
| P | .53 | 1.53 | .013 | .009 | 1.98 | 1.51 | .22 | .17 | .23 | .19 | .015 | .007 |
| Q | .31 | 1.47 | .012 | .008 | .32 | 1.44 | .22 | .17 | .23 | .22 | .082 | .006 |
| R | .40 | .75 | .010 | .008 | .25 | 1.66 | — | — | .20 | — | .085 | — |
| S | .42 | .71 | .008 | .010 | .22 | 1.79 | .91 | — | .26 | — | .013 | .006 |
| T | .41 | 1.35 | .010 | .018 | .26 | 1.45 | .18 | .19 | .24 | .21 | .021 | .003 |

*500 lbs., laboratory ingots

TABLE VI

| | SURFACE ROUGHNESS, MEASURED AND CALCULATED | | |
|---|---|---|---|
| Steel | Measured Surface Roughness ($\mu$-inch) | Calculated Surface Roughness ($\mu$-Inch) | Corrected for Boron ($\mu$-inch) |
| A | 1.07 | .64 | 1.11 |
| B | 1.47 | .64 | 1.11 |
| C | 2.4 | 1.27 | 2.21 |
| D | 1.82 | .69 | 1.2 |
| E | 3.2 | 1.2 | 2.09 |
| F | 2.57 | 1.5 | 2.61 |
| G | 1.57 | 1.31 | 2.28 |
| H | 2.0 | 1.44 | 2.51 |
| I | 2.17 | 1.37 | 2.38 |
| J | 2.27 | 1.71 | 2.98 |
| K | 2.47 | .98 | 1.71 |
| L | 2.45 | .86 | 1.50 |
| M | 3.29 | 1.33 | 2.31 |
| N | 1.0 | 1.12 | |
| O | 1.24 | 0.99 | |
| P | 3.2 | 1.6 | |
| Q | 2.62 | 3.54 | |
| R | 2.23 | 1.24 | |
| S | 1.15 | 1.94 | |

TABLE VI-continued

| Steel | SURFACE ROUGHNESS, MEASURED AND CALCULATED: Measured Surface Roughness (μ-inch) | Calculated Surface Roughness (μ-Inch) | Corrected for Boron (μ-inch) |
|---|---|---|---|
| T | 2.53 | 2.22 | |

TABLE VII

| Steel | PROPERTIES, HARDNESS AND TOUGHNESS: 300° D.T.* Hardness HRC | 300° D.T.* Toughness Cv-Ft. L | 300° D.T.* Toughness Lbs T | 400° D.T.** Hardness HRC | 400° D.T.** Toughness Cv-Ft. L | 400° D.T.** Toughness Lbs T |
|---|---|---|---|---|---|---|
| A | 60.5 | 6.3 | 6.7 | 57.5 | 8.7 | 10.2 |
| B | 57.5 | 6 | 8.5 | 56.5 | 8.3 | 10.5 |
| C | 58.5 | 8.7 | 12 | 55.5 | 10.7 | 13.8 |
| D | 59 | 7 | 9.3 | 56.5 | 8.3 | 10.7 |
| E | 60 | 4.5 | 7.3 | 57 | 6 | 9.5 |
| F | 57 | 9.5 | 10.5 | 54 | 9.5 | 11.7 |
| G | | | | 56.5 | — | 12.2 |
| H | | | | 56.5 | — | 12 |
| I | | | | 56 | — | 12 |
| J | | | | 55 | — | 13.3 |
| K | | | | 55.5 | — | 12.7 |
| L | | | | 56 | — | 9.7 |
| M | | | | 56 | — | 11 |
| N | 59 | 5 | 6 | 56 | 7.2 | 8.5 |
| O | 59.5 | 5 | 5 | 57 | 7.2 | 7.3 |
| P | 59.5 | 3.8 | 7.8 | 58 | 6.3 | 7.8 |
| Q | 51 | 10.7 | 15.7 | 50.5 | 10.7 | 17.3 |
| R | 55 | 10.5 | 16 | 53.5 | 11 | 13.5 |
| S | 55.5 | 11.2 | 14 | 53 | 11.7 | 16.7 |
| T | 55 | 10.5 | 16 | 53 | 10 | 16.3 |

*double temper, i.e. austenitize at 1650° F. (1 hr./inch thickness) oil cooling, temper at 300° F. (2 hr./inch thickness), refrigerate in liquid nitrogen (1 hr.), temper at 300° F. (2 hr./inch thickness)

**same as above, except temper at 400° F.

To demonstrate the improvement in properties, particularly a reduction in the quantity of retained austenite present in the heat treated steels of this invention, through the use of a double temper, Steels G and H were subjected to a variety of heat treatment cycles, note TABLE VIII.

TABLE VIII

| Treatment* | PROPERTIES WITH VARYING HEAT TREATMENTS: Steel G Hardness HRC | Steel G Toughness Cv-Ft. Lbs L | Steel G Retained Austenite (%) | Steel H Hardness HRC | Steel H Toughness Cv-Ft. Lbs L | Steel H Retained Austenite (%) |
|---|---|---|---|---|---|---|
| 300° S.T. - oil | 60.5/61.5 | 10.5 | 11.9 | 60/61 | 8.3 | 14.8 |
| 300° D.T. - oil | 61/61.5 | 7.8 | 6 | 61 | 6.3 | 11.1 |
| 300° S.T. - air | 61/61.5 | 10.5 | 11.7 | 61 | 7 | 14.8 |
| 300° D.T. - air | 61/61.5 | 9.2 | 2.6 | 61.5 | 5.7 | 5.6 |
| 400° S.T. - oil | 56/57 | 13 | 12 | 56.5/57.5 | 9.3 | 14.5 |
| 400° D.T. - oil | 56.5/57 | 12.5 | 7.3 | 57 | 11 | 14 |
| 400° S.T. - air | 57 | 13.3 | 14.8 | 57/58 | 10.5 | 17 |
| 400° D.T. - air | 57.5 | 12.5 | 9.4 | 58 | 11.5 | 9.6 |

*treatments consisted of austenitizing at 1650° F. (1 hr./inch thickness), air or oil cooling as indicated, followed by a single temper (S.T.) or double temper (D.T.) at the designated temperature for 2 hr./inch thickness; where D.T., refrigeration for one hour in liquid nitrogen occurred immediately after first temper followed by second temper

I claim:

1. In a heat treated ferrous alloy, adapted for use as a die steel, where the heat treatment includes austenitizing, cooling and tempering, said alloy characterized in the heat treated condition by a hardness of at least 55 $R_c$ and a charpy V-notch toughness of at least 6 ft-lbs., a high level of hardenability, and the capability of achieving a high polished surface flatness, said alloy consisting essentially of, by weight, carbon between 0.4 to 0.7%, manganese between 1.1 to 2.2%, nickel between 1.0 to 1.7%, a maximum of 0.025% phosphorus, a maximum of 0.025% sulfur, a maximum of 2.0% silicon, a maximum of 0.1% niobium, a maximum of 0.5% titanium, a maximum of 4.0% cobalt, a maximum of 0.10% aluminum, balance iron, the improvement comprising in combination therewith the provision of improving the hardenability of said alloy by adding thereto at least one element selected from the group consisting of a maximum of 3.0% chromium, a maximum of 1.5% molybdenum, a maximum of 1.5% tungsten, a maximum of 1.0% vanadium, and boron between 0.0005 and 0.12%, provided that the addition of at least one said element to improve hardenability does not result in an increase in the austenitizing temperature above about 1700° F., and that the chemistry of said alloy is further adjusted to satisfy the equation:

Surface Roughness (μ-inch)=Boron factor [7.07−12.5 (% C)+0.72 (% Mn)+0.45 (% Si)−2.9 (% Ni)+1.13 (% Ni)$^2$+0.87 (% Cr)+2.1 (% V)+1.12 (% Mo)+0.84 (% W)+14 (% Nb)], where the calculated Surface Roughness is no greater than 2.65 μ-inch, and that the Boron factor is 1.0 when boron is not present in the above given range, and 1.74 when boron is present.

2. In a heat treated ferrous alloy, adapted for use as a die steel, where the heat treatment includes austenitizing, oil quenching and tempering, said alloy characterized in the heat treated condition by a hardness of at least 55 $R_c$ and a charpy V-notch toughness of at least 6 ft-lbs., a high level of hardenability, and the capability of achieving a high polished surface flatness, said alloy consisting essentially of, by weight, carbon between 0.4 to 0.7%, manganese between 1.1 to 2.2%, nickel between 1.0 to 1.7%, a maximum of 0.025% phosphorus, a maximum of 0.025% sulfur, a maximum of 2.0% silicon, a maximum of 0.1% niobium, a maximum of 0.5% titanium, a maximum of 4.0% cobalt, a maximum of 0.10% aluminum, balance iron, the improvement comprising in combination therewith the provision of improving the hardenability of said alloy by adding thereto at least one element selected from the group consisting of a maximum of 3.0% chromium, a maximum of 1.5% molybdenum, a maximum of 1.5% tungsten, and a maximum of 1.0% vanadium, provided that the addition of at least one said element to improve hardenability does not result in an increase in the austenitizing temperature above about 1700° F., and that the chemistry of said alloy is further adjusted to satisfy the equation:

Surface Roughness ($\mu$-inch)=[7.07-12.5 (% C)+0.72 (% Mn)+0.45 (% Si)−2.9 (% Ni)+1.13 (% Ni)$^2$+0.87 (% Cr)+2.1 (% V)+1.12 (% Mo)+0.84 (% W)+14 (% Nb)], where the calculated Surface Roughness is no greater than 2.65 $\mu$-inch.

3. In a heat treated ferrous alloy, adapted for use as a die steel, where the heat treatment includes austenitizing, cooling in air and tempering, said alloy characterized in the heat treated condition by a hardness of at least 55 $R_c$ and a charpy V-notch toughness of at least 6 ft-lbs., a high level of hardenability, and the capability of achieving a high polished surface flatness, said alloy consisting essentially of, by weight, carbon between 0.4 to 0.7%, manganese between 1.1 to 2.2%, nickel between 1.0 to 1.7%, a maximum of 0.025% phosphorus, a maximum of 0.025% sulfur, a maximum of 2.0% silicon, a maximum of 0.1% niobium, a maximum of 0.5% titanium, a maximum of 4.0% cobalt, a maximum of 0.10% aluminum, boron between 0.0005 and 0.012%, balance iron, the improvement comprising in combination therewith the provision of improving the hardenability of said alloy by adding thereto at least one element selected from the group consisting of a maximum of 3.0% chromium, a maximum of 1.5% molybdenum, a maximum of 1.5% tungsten, and a maximum of 1.0% vanadium, provided that the addition of at least one said element to improve hardenability does not result in an increase in the austenitizing temperature above about 1700° F., and that the chemistry of said alloy is further adjusted to satisfy the equation:

Surface Roughness ($\mu$-inch)=1.74 [7.07-12.5 (% C)+0.72 (% Mn)+0.45 (% Si)−2.9 (% Ni)+1.13 (% Ni)$^2$+0.87 (% Cr)+2.1 (% V)+1.12 (% Mo)+0.84 (% W)+14 (% Nb)], where the calculated Surface Roughness is no greater than 2.65 $\mu$-inch.

4. A heat treated ferrous mold adapted for use as a die for injection molding of plastics to form lenses and the like, where the ferrous mold has been heat treated by the steps which include austenitizing, cooling and tempering, said mold comprising a ferrous alloy, said alloy consisting essentially of, by weight, carbon between 0.4 to 0.7%, manganese between 1.1 to 2.2%, nickel between 1.0 to 1.7%, a maximum of 0.025% phosphorus, a maximum of 0.025% sulfur, a maximum of 2.0% silicon, a maximum of 0.1% niobium, a maximum of 0.5% titanium, a maximum of 4.0% cobalt, a maximum of 0.10% aluminum, at least one hardenability promoting element selected from the group consisting of a maximum of 3.0% chromium, a maximum of 1.5% molybdenum, a maximum of 1.5% tungsten, a maximum of 1.0% vanadium, and boron between 0.0005 and 0.012%, balance iron, characterized in that (1) the addition of at least one said element to promote hardenability does not result in an increase in the austenitizing temperature above about 1700° F., (2) the chemistry of said alloy is adjusted to satisfy the equation:

Surface Roughness ($\mu$-inch)=Boron factor [7.07-12.5 (% C)+0.72 (% Mn)+0.45 (% Si)−2.9 (% Ni)+1.13 (% Ni)$^2$+0.87 (% Cr)+2.1 (% V)+1.12 (% Mo)+0.84 (% W)+14 (%Nb)], where the calculated Surface Roughness is no greater than 2.65 $\mu$-inch, and that the Boron factor is 1.0 when boron is not present in the above given range, and 1.74 when boron is present, and (3) in the heat treated condition said mold possesses a hardness of at least 55 $R_c$, a charpy V-notch toughness of at least 6 ft-lbs., and a high level of hardenability.

5. The ferrous alloy according to any one of claims 1-3 wherein the hardenability promoting elements chromium, vanadium, molybdenum and tungsten may be present up to the following amounts:

chromium—0.75% max.
vanadium—0.35% max.
molybdenum—1.0% max., and
tungsten—0.75% max.

6. The oil quenched and tempered ferrous alloy according to claim 2 wherein said alloy consists essentially of carbon 0.47 to 0.56%, manganese 1.3 to 1.6%, silicon 0.15 to 0.30%, nickel 1.1 to 1.5%, chromium 0.15 to 0.25%, vanadium 0.08 to 0.20%, molybdenum 0.20 to 0.30%, tungsten 0.15 to 0.30%, aluminum 0.02 to 0.06%, balance substantially iron.

7. The air hardened and tempered ferrous alloy according to claim 3 wherein said alloy consists essentially of carbon 0.47 to 0.57%, manganese 1.8 to 2.1%, silicon 0.15 to 0.30%, nickel 1.1 to 1.5%, chromium 0.30 to 0.50%, vanadium 0.08 to 0.20%, molybdenum 0.65 to 0.80%, tungsten 0.35 to 0.45%, titanium 0.02 to 0.04%, aluminum 0.02 to 0.06%, boron 0.001 to 0.003%, balance substantially iron.

* * * * *

UNITED STATES PATENT AND TRADEMARK OFFICE

CERTIFICATE OF CORRECTION

PATENT NO. : 4,171,233

DATED : October 16, 1979

INVENTOR(S) : George F. Vander Voort

It is certified that error appears in the above—identified patent and that said Letters Patent is hereby corrected as shown below:

Column 2, line 48, "steel" should read -- steels --.

Column 5, in the table under th4 2nd column "up to 4.0" should read -- ( --Co up to .01 --).

Column 12, line 13, "0.12%" should read -- 0.012% --.

Signed and Sealed this

*Twenty-second* Day of *January 1980*

[SEAL]

*Attest:*

SIDNEY A. DIAMOND

*Attesting Officer*

*Commissioner of Patents and Trademarks*